US009482018B2

(12) United States Patent
Torrents I Comas

(10) Patent No.: US 9,482,018 B2
(45) Date of Patent: Nov. 1, 2016

(54) DEVICE FOR LEVELLING AND ALIGNING SURFACE COVERING PARTS

(71) Applicant: TORRENTS RESEARCH, S.L, Mataró(Barcelona) (ES)

(72) Inventor: Josep Torrents I Comas, Mataró (ES)

(73) Assignee: TORRENTS RESEARCH, S.L., Mataro (Barcelona) (ES)

( * ) Notice: Subject to any disclaimer, the term of this patent is extended or adjusted under 35 U.S.C. 154(b) by 0 days.

(21) Appl. No.: 14/784,048

(22) PCT Filed: Feb. 20, 2014

(86) PCT No.: PCT/ES2014/070128

§ 371 (c)(1),
(2) Date: Oct. 13, 2015

(87) PCT Pub. No.: WO2014/177736

PCT Pub. Date: Nov. 6, 2014

(65) Prior Publication Data

US 2016/0053501 A1 Feb. 25, 2016

(30) Foreign Application Priority Data

Apr. 30, 2013 (ES) ..... 201330526 U

(51) Int. Cl.
*E04B 2/82* (2006.01)
*E04B 9/00* (2006.01)
(Continued)

(52) U.S. Cl.
CPC ..... *E04F 21/0092* (2013.01); *E04F 21/1877* (2013.01); *E04F 21/22* (2013.01); *E04F 15/02005* (2013.01); *E04F 15/02027* (2013.01);
(Continued)

(58) Field of Classification Search
CPC ..... E04F 21/20; E04F 21/0092; E04F 15/02005; E04F 15/02027; E04F 15/02033; E04F 21/1877; E04F 21/1894
USPC ..... 52/749.11, 126.5, 126.1, 127.5
See application file for complete search history.

(56) References Cited

U.S. PATENT DOCUMENTS 4,397,125 A 8/1983 Gussler et al.
5,675,942 A 10/1997 Crawford
(Continued)

FOREIGN PATENT DOCUMENTS

| | | |
|---|---|---|
| AU | 2012101175 | 8/2012 |
| BE | 815222 | 9/1974 |
| ES | 1 070 518 | 9/2009 |

OTHER PUBLICATIONS

International Search Report issued Apr. 28, 2014 in International (PCT) Application No. PCT/ES2014/070128.

*Primary Examiner* — Chi Q Nguyen
(74) *Attorney, Agent, or Firm* — Wenderoth, Lind & Ponack, L.L.P.

(57) ABSTRACT

A device used in the installation of a surface of ceramic parts that are levelled and aligned using a securing product. The device includes: a base, with an orthogonal cross-shaped structure formed of four arms, having an undulating surface; and at least two flexible planar attachments projecting up from the base and positioned symmetrically along the length of the base. The opposing planar surfaces of each of the flexible attachments including side ribs for slidably mounting and guiding upper bodies which, by applying pressure, contact with the upper surface of multiple covering parts (P), thereby being levelled.

10 Claims, 10 Drawing Sheets

(51) Int. Cl.

| | |
|---|---|
| ***E04G 1/22*** | (2006.01) |
| ***E04F 21/00*** | (2006.01) |
| ***E04F 21/22*** | (2006.01) |
| *E04F 21/20* | (2006.01) |
| *E04F 15/02* | (2006.01) |
| *E04F 21/18* | (2006.01) |

(52) U.S. Cl.
CPC ..... *E04F 15/02033* (2013.01); *E04F 21/1894* (2013.01); *E04F 21/20* (2013.01)

(56) References Cited

U.S. PATENT DOCUMENTS

| | | | | |
|---|---|---|---|---|
| 8,181,420 | B2 | 5/2012 | Torrents I Comas | |
| 8,429,879 | B1 * | 4/2013 | Hoffman | E04F 21/0092 52/747.11 |
| 8,800,246 | B2 * | 8/2014 | Gorton | E04F 21/22 52/747.11 |
| 9,027,308 | B2 * | 5/2015 | Kufner | E04F 21/00 52/126.6 |
| 2006/0185269 | A1 | 8/2006 | Kufner et al. | |
| 2006/0185319 | A1 | 8/2006 | Kufner et al. | |
| 2010/0263304 | A1 | 10/2010 | Torrents I Comas | |
| 2013/0055675 | A1 | 3/2013 | Sighinolfi | |
| 2014/0033640 | A1 | 2/2014 | Gorton | |
| 2014/0116001 | A1 * | 5/2014 | Ghelfi | E04F 21/0092 52/749.11 |
| 2014/0298736 | A1 * | 10/2014 | Bunch | E04F 21/0092 52/126.1 |

* cited by examiner

DEVICE FOR LEVELLING AND ALIGNING SURFACE COVERING PARTS

BACKGROUND OF THE INVENTION

1. Technical Field

This invention relates to a device for levelling and aligning surface covering parts, appropriate to install a surface of ceramic parts or similar that are suitably levelled and aligned.

The invention is applicable in the field of construction and refurbishment, particularly in the application of surface covering tiles or parts.

2. Description of the Related Art

There currently exist in the market different devices designed to facilitate the levelling and alignment of surface covering parts using a layer of mortar, glue cement or other suitable adhesive for securing them to the surface in question.

The purpose of these known devices is to facilitate the correct positioning of the parts forming the covering, so that the covering defines a flat, levelled surface, and the parts in question are kept at uniform distance apart.

A known device is described in the U.S. Pat. No. 4,397,125, which has a rear plate with a hole in which a screw or protruding tab is fixed directly with fixing means to said screw. Said device also has a front clamping plate mounted on it, which is forced against the rear plate by a wing nut or similar, in order to trap the covering parts by their edges. The device in this patent has a number of drawbacks, notably that the threaded parts of the screw and/or wing nut may be rendered useless if they come into contact with the mortar or fixing material for the covering parts, and the excessively large separation between said parts because of the thickness of the screw, especially when the parts to be used are of small dimensions.

The document U.S. Pat. No. 5,675,942 describes an aligning and spacing device for wall panels which comprises a base plate with an attachment or locking stem, locking plate and lock which keep the front and rear sides of a pair of panels laterally aligned with a surface while the securing product for said panels dries.

The lock incorporated in the locking plate is coupled to the stem using complementary gear teeth of sizeable dimensions, which means that there is an excessive length between the successive holding points and that the alignment and levelling of the parts forming the covering is not sufficiently precise.

Other known devices are described, for example, in patent documents US 2006/0185269 and US 2006/0185319, which have a top plate with an array of spacer fins and a bottom plate, in which the plates are joined by a stem or attachment which extends from the bottom plate through the top plate. This stem has a number of notches for lateral mounting of a metal insert to hold the top plate in position.

As in the previous case, these inventions do not allow progressive insertion and appropriate adjustment of the top plate during the levelling of the parts which form the covering.

The Spanish utility model ES 1070518 U describes a levelling device for the positioning of covering parts which comprises a flat lower body from which a flexible attachment emerges from above for placing between the covering parts and a second upper body with a through hole for adjustable mounting on the flexible attachment. Said flexible attachment has a rectangular cross-section and, on its larger faces, two opposing gear teeth whose teeth are offset lengthwise. The through hole of the second body comprises two opposing ratchets which mesh in an alternate manner with the teeth corresponding to the two sides of the flexible attachment, providing a greater number of fixing points than in the abovementioned inventions.

This invention, like the previous ones, has the disadvantage that each device is positioned individually, which makes alignment and levelling of covering parts difficult, especially when they are of longer length. Another drawback in use comes from the fact that a large number of individual, independent devices must be used for the alignment and levelling of the covering parts.

Another drawback of this device is determined precisely by the flat configuration of the lower body, which prevents the covering parts from being gripped correctly in the cement or fixing medium with regard to the surface to be covered.

SUMMARY OF THE INVENTION

This invention describes a device for levelling and aligning surface covering parts, which device that can be used to install a surface of ceramic parts or similar that are suitably levelled and aligned, using a securing product.

The device comprises a base and flexible attachments with their respective upper bodies. The attachments protrude from the top of the base and have lateral gear teeth. The upper bodies are suitable for pressing onto the upper surface of the covering parts. The upper bodies have a through hole so that they can be mounted in sliding fashion on the flexible attachments, towards the base. For this purpose, they have internal gear teeth designed to act against the gear teeth incorporated in the flexible attachments, holding the upper body in an operating position against the covering parts.

The device comprises a base with an undulated surface, creating a series of alternating troughs and peaks along its length, which are suitable for the penetration of the securing product for the covering parts.

The device also comprises at least two flexible planar attachments, which protrude from the top of the base, and are arranged to correspond with a longitudinal middle plane on the base, separated along its length, in which each of the flexible attachments has on the opposing planar surfaces: side ribs for guiding and sliding assembly of the two upper tightening bodies on the upper surface of the covering parts, and central gear teeth which are suitable for the action of complementary teeth on the respective upper bodies.

The device has a base in the form of an orthogonal cross formed by four arms.

The cross-shaped base comprises a rectangular promontory located in the geometrical centre and oriented according to two of the arms of the cross. One of the arms of the cross-shaped base comprises, on its non-free end, a crosswise weakening line which extends the two adjacent arms, suitable for separating the arm from the rest of the base, giving it a T-shaped structure.

Each of the arms of the cross-shaped base comprises a projection with a rectangular drill-hole positioned to coincide with the base, which forms a hollow in the opposite side of the base and copies the structure of the projection to maintain the thickness of the base.

The projections have a rectangular structure with curved shorter sides and longer sides parallel to the rectangular drill-hole and, consequently, to the longer sides of the arms of the cross-shaped base.

The independent flexible attachment comprises a support which fits in the hollow of the projection when inserted through the drill-hole in the projection.

The non-free end of the flexible attachments has holes which define an area of weakening suitable for breaking.

BRIEF DESCRIPTION OF THE DRAWINGS

To complement the description being made, and to make it easier to understand the characteristics of the invention, this descriptive report is accompanied by a set of drawings in which, for illustrative purposes and without limitations, the following has been represented.

Figure 1:
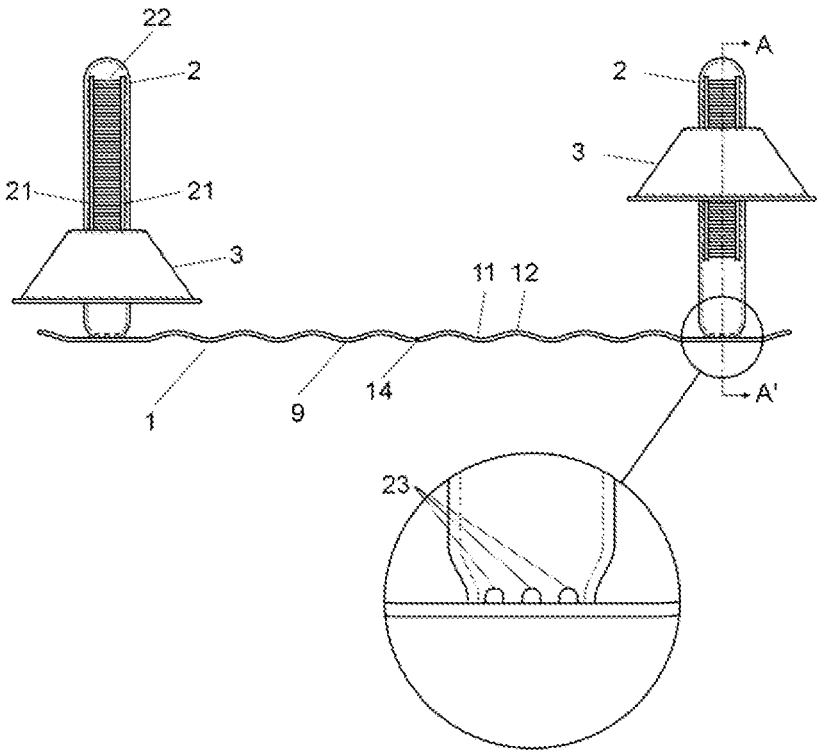
FIG. 1 shows an elevation view of a device for levelling and aligning surface covering parts in a first embodiment, which shows the base and two flexible attachments with their corresponding upper bodies and an enlargement of the area of weakening at the base of the flexible attachments.
Figure 2:
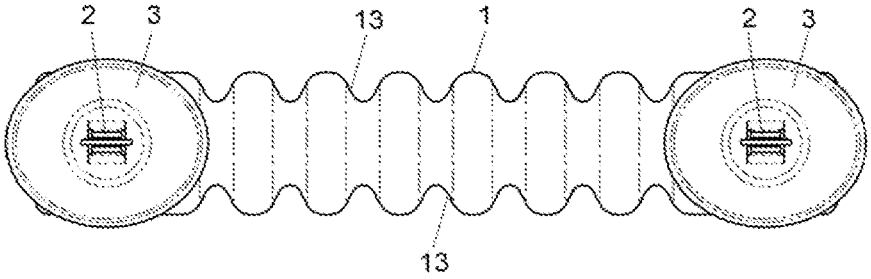
FIG. 2 shows a top plane view of the device in the previous figure.
Figure 3:
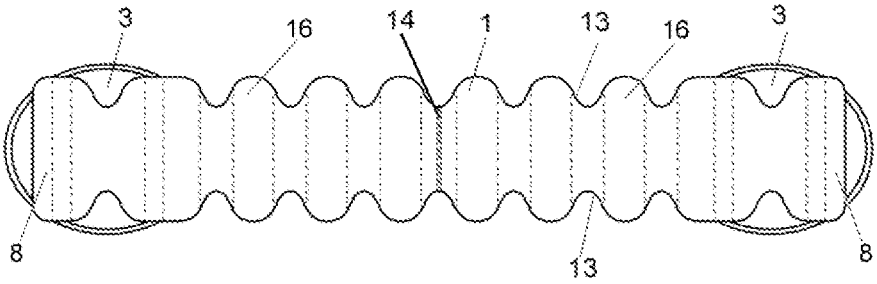
FIG. 3 shows a low plane view of the device in the previous figures.

Provided below is a list of the references used in the figures:

| | |
|---|---|
| 1. | First base. |
| 1'. | Second base. |
| 1''. | Third base. |
| 2. | Incorporated flexible attachment. |
| 2'. | Independent flexible attachment. |
| 3. | Upper body. |
| 4. | Support for the independent flexible attachment. |
| 5. | Projection. |

-continued

| | |
|---|---|
| 6. | Rectangular drill-hole. |
| 7. | Rectangular promontory. |
| 8. | Ends of the base. |
| 9. | Undulated structure of the base. |
| 10. | Hollow in the projection. |
| 11. | Troughs in the undulated surface. |
| 12. | Peaks in the undulated surface. |
| 13. | Undulated profile. |
| 14. | Weakening line. |
| 15. | Arm of the cross-shaped base. |
| 16. | Separable base segment. |
| 17. | Perforations. |
| 21. | Side ribs. |
| 22. | Central gear teeth. |
| 23. | Holes. |
| 31. | Through hole. |
| 32. | Gear tooth. |
| P. | Covering parts. |

DETAILED DESCRIPTION OF THE INVENTION

The device in the current disclosure has preferably three forms of embodiment, differentiated basically in the structure of the bases (1, 1') and in the way the flexible attachments (2, 2') are attached to the bases (1, 1').

In a first embodiment, and as can be seen in the attached FIGS. 1 to 4, the device in the invention comprises a first rectangular base (1) with a longitudinal structure.

In a second embodiment, and as presented in FIGS. 5 to 15, the device in the invention comprises a second base (1'). This second base (1') is rectangular with a longitudinal structure or with a structure in the form of an orthogonal cross, in which the base (1') has two or four ends (8), respectively.

The bases (1, 1') have a longitudinal section with an undulated structure (9) which defines a series of troughs (11) and peaks (12) alternating along its length. In addition, the rectangular form of the longitudinal bases (1, 1') and of the arms (15) of the cross-shaped base (1') has an undulated configuration (13) on the longer sides, as represented, amongst others, in FIGS. 2 and 3.

Figure 12:
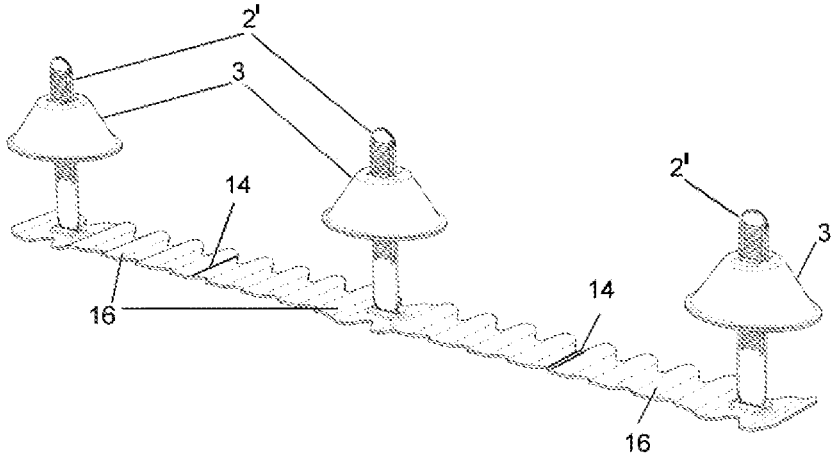
FIG. 12 shows a perspective view of the device in the second embodiment with an extended longitudinal base.
Figure 13:
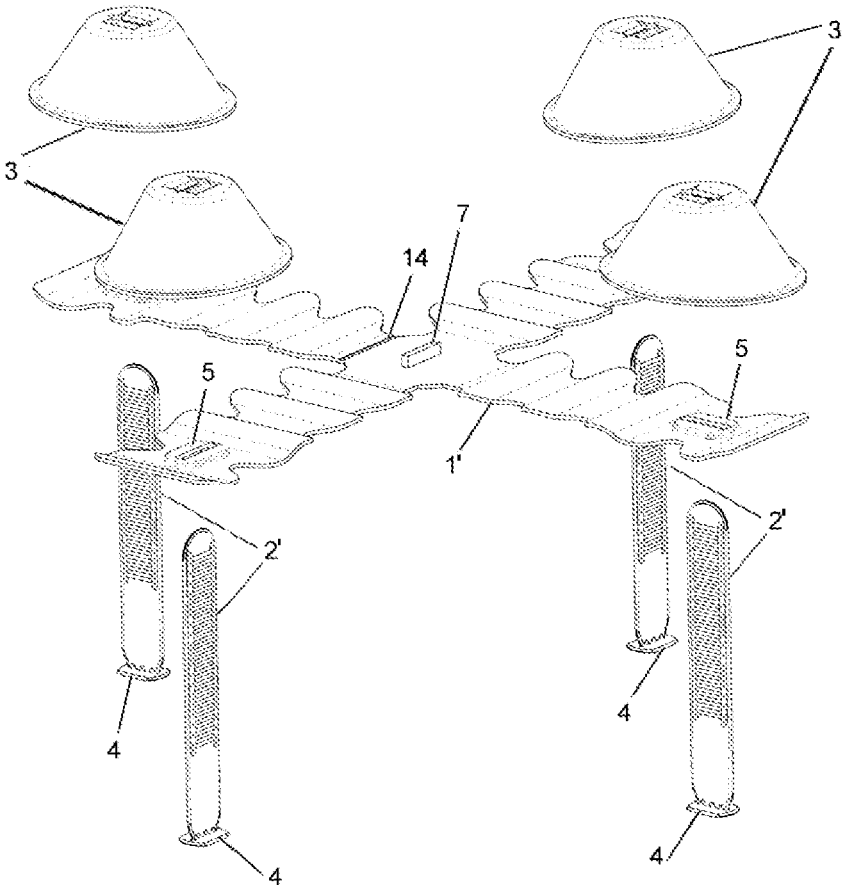
FIG. 13 shows an exploded perspective view of the device in an embodiment with a cross-shaped base.
Figure 14:
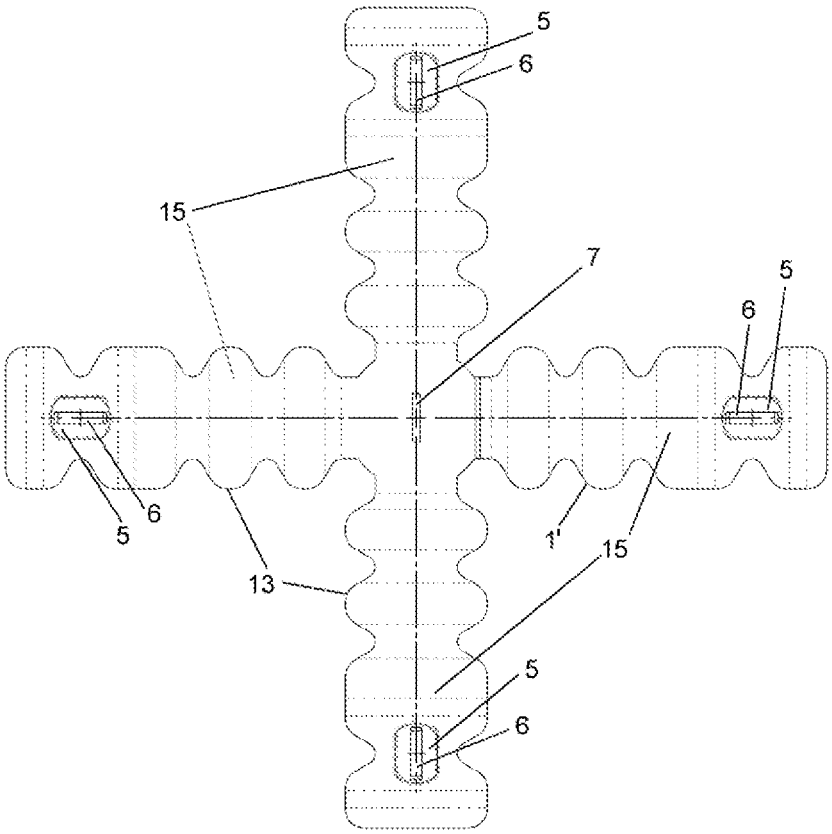
FIG. 14 represents a top plane view of the device shown in FIG. 13.

The bases (1, 1') incorporate at least two flexible planar attachments (2, 2'), arranged to coincide with a longitudinal middle plane on the bases (1, 1'). The flexible attachments (2, 2') are arranged symmetrically on the bases (1, 1') along their length, with two of these attachments close to the ends (8) of the bases (1, 1'). In this way, bases (1, 1') with just two attachments (2, 2') can be found in the two forms of embodiment described. However, the second embodiment allows the incorporation of three flexible attachments (2'), as represented in FIG. 12.

The flexible attachments (2) in the first embodiment are fixed to the base (1) to form a single part.

The flexible attachments (2') in the second embodiment are independent and fixed to the base (1') by pressure.

Figure 9:
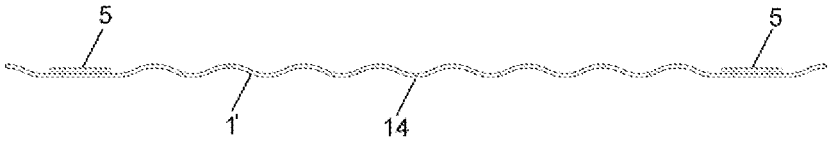
FIG. 9 shows an elevation view of the device represented in the previous figure.
Figure 10:
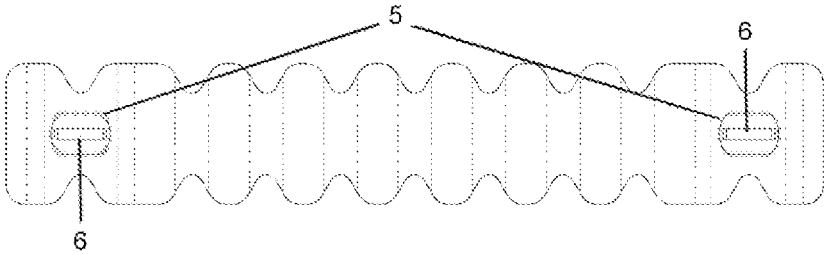
FIG. 10 shows a top plane view of the device represented in the previous figure.
Figure 15:
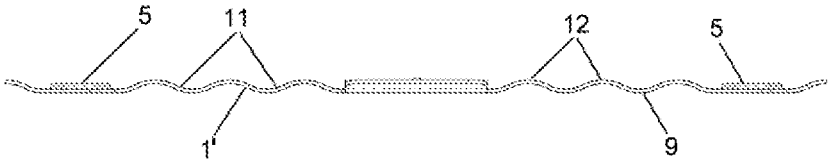
FIG. 15 shows an elevation view of the device represented in the previous figure.

In the second embodiment, the second base (1') has, in the areas where the attachments (2') are located, strengthening projections (5) of a height which does not exceed the troughs (11) of the undulated structure (9) of the base (1'). This detail is represented in FIGS. 9 and 15.

The projections (5) in the second embodiment have a circular structure with the perimeter cut by two diametrically symmetrical lines, creating a rectangular shape with circular shorter sides, oriented in the longitudinal direction of the segments (16) of the base (1') or of the arms (15) if the base (1') has a cross-shaped structure.

The projections (5) have a hollow (10) on the opposite side of the base (1') which copies the structure of the projection (5), so that the thickness of the base (1') is roughly maintained.

The projections (5) incorporate a rectangular drill-hole (6) passing through, which are geometrically aligned with the segments (16) of the base (1') or with the arms (15) if the base (1') has a cross-shaped structure.

The independent flexible attachments (2') in the second embodiment are identical to the flexible attachments (2) incorporated and fixed to the device, with the only difference being that they are separated from the base (1) in which they were incorporated as described for the first embodiment, and including a support (4) with a structure which copies the structure of the hollow (10) in the projections (5). In this way, the independent flexible attachments (2') are inserted through the rectangular drill-holes (6) until the support (4) for the independent attachments (2') is attached in the hollow (10) of the projection (5).

It should be noted that the dimensions of the rectangular drill-holes (6) are greater than the dimensions of the section of the flexible attachments (2') which pass through the drill-holes (6) so that, when inserted into them, the flexible attachments (2') have a certain amount of play and are not aligned with the base (1'). When the support (4) which adjusts in the hollow (10) of the projection (5) is included, the position is fully defined.

Another characteristic of the bases (1, 1') is that they comprise crosswise weakening lines (14) for the separation or splitting of the base (1, 1') into independent segments (16). These weakening lines (14) are halfway between every two projections (5) in the case of bases (1, 1') with a longitudinal structure. In the case of bases (1') with an orthogonal cross-shaped structure, the weakening line (14) is a continuation of the longitudinal structure of the adjacent arms (15). In this way, if one arm (15) is eliminated, a segment (16) separated from the base (1') is obtained, together with a T-shaped base (1') with a structure with no protruding areas.

In this way, considering the first embodiment, the segments (16) separated from the base (1) have the corresponding flexible attachment (2) so that it can be positioned individually, if it is not possible to use the full structure of the device because of problems of space.

In the base (1') with a longitudinal structure, various independent segments (16) can also be obtained, with as many independent segments (16) as there are projections (5) in the base (1'), to be used as bases (1') in situations where there are problems of space.

The base (1') with an orthogonal cross-shape structure also has, in the geometrical centre and positioned in the direction of one of the arms (15), a rectangular promontory (7) which is used to ensure that the separation of the covering parts (P) to be positioned is exactly the same along the whole length of the flooring to be covered. A crosspiece like those known in the state of the art can be mounted on this rectangular promontory (7), although it does not form part of this invention.

Figure 16:
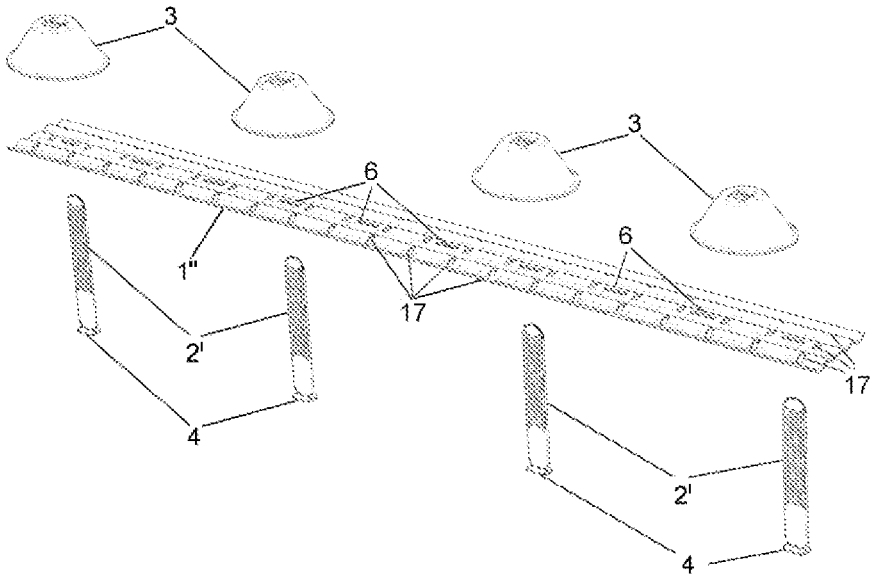
FIG. 16 shows a form of representation of a device with extruded base for use with large size parts.

In a third embodiment, the device has more than three flexible attachments (2'). The base (1") is formed of a surface with an undulated structure (9) which comprises a series of perforations (17) positioned crosswise to the base (1") on both sides of each rectangular drill-hole (6). The perforations (17) facilitate the penetration of the cement or fixing medium for the covering parts (P) and the levelling thereof when pressed from above by the upper bodies (3) of the device. The base (1") in this embodiment has a surface with an undulated structure (9) in a perpendicular direction to that used in the previous embodiments, so that it can be manufactured by extrusion. Both the rectangular drill-holes (6) and the perforations (17) are created at a later stage of manufacture. An example is shown in FIG. 16, which is especially suitable for situations in which covering parts (P) of a large size are used, for example parts measuring 2 m by 1 m.

In all the embodiments, the device comprises upper bodies (3) provided with a through hole (31) for sliding assembly on the respective flexible attachments (2, 2') towards the base (1, 1', 1").

Figure 4:
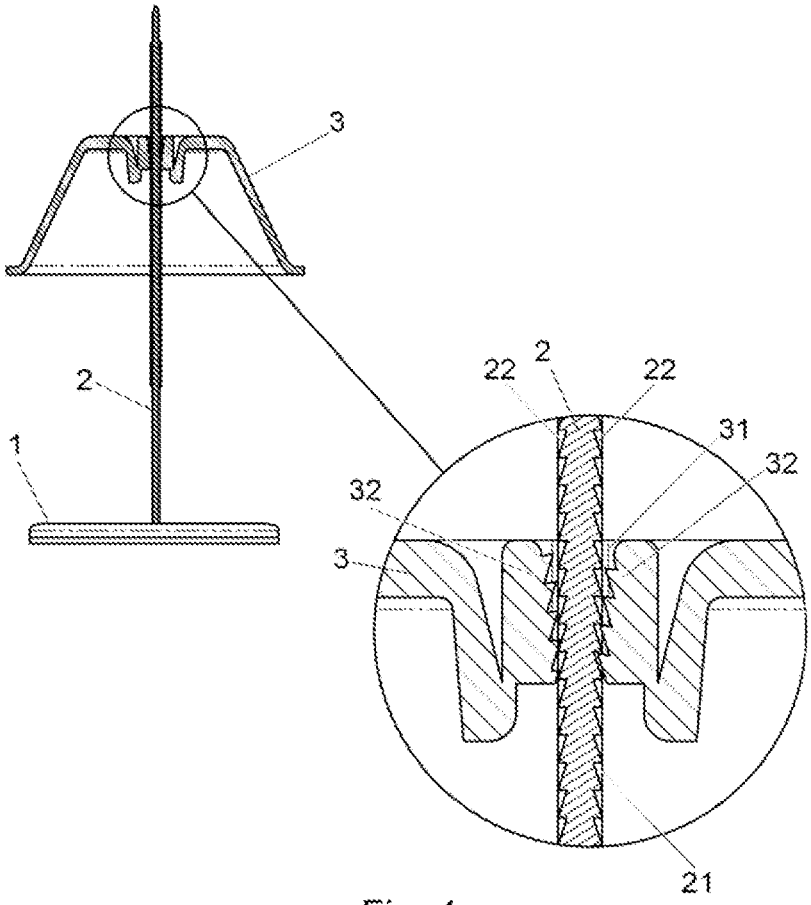
FIG. 4 shows a view of the A-A' section marked in FIG. 1, showing an enlargement of the gear-teeth area for coupling the upper body to the flexible attachment.
Figure 5:
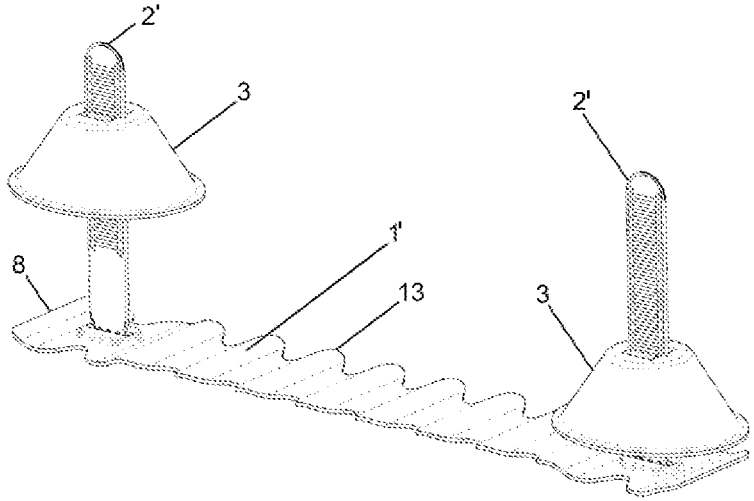
FIG. 5 shows a higher perspective view of a device for levelling and aligning surface covering parts in a second embodiment with a longitudinal base.
Figure 6:
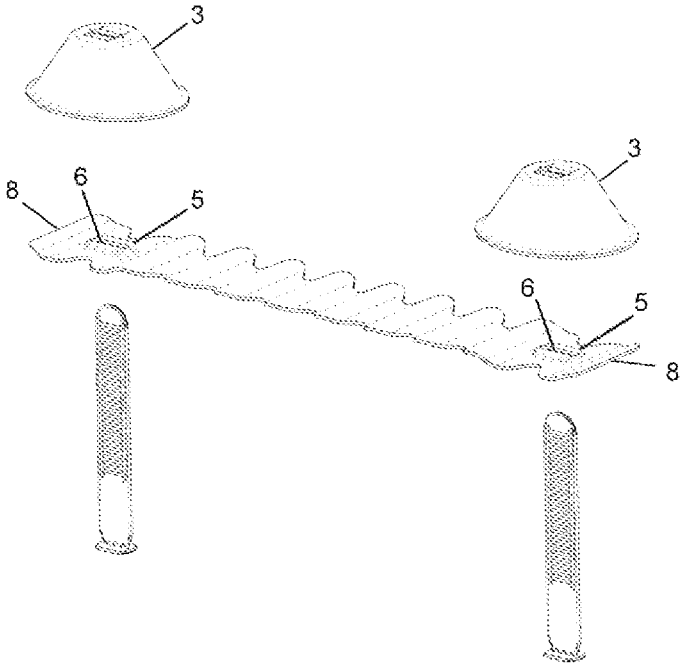
FIG. 6 shows an exploded perspective view of the device represented in FIG. 5.
Figure 7:
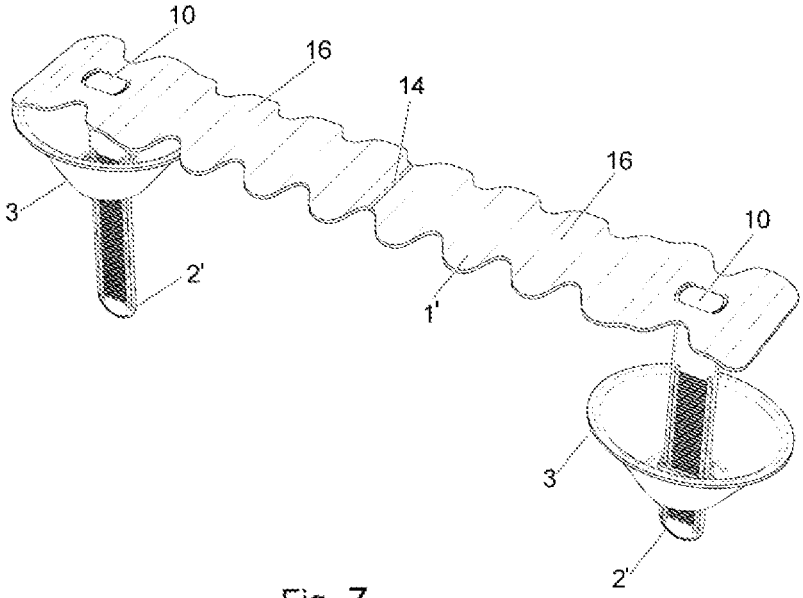
FIG. 7 shows an underside view of the device shown in FIGS. 5 and 6.
Figure 8:
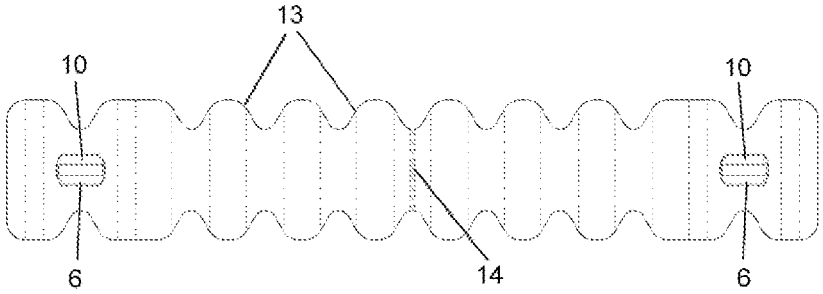
FIG. 8 shows a low plane view of the device represented in FIGS. 5 to 7.

As can be seen in the figures, the flexible attachments (2, 2') each have two opposing planar surfaces with side ribs (21) for guiding the respective upper bodies (3), and central gear teeth (22), with the teeth at the same height, as represented in the expanded detail in FIG. 4.

For their part, the upper bodies (3) designed to be mounted on the respective flexible attachments (2, 2') have in the through hole (31) two gear teeth (32) at offset heights, at a distance approximately equal to half the length of the teeth, as shown in the detail of FIG. 4, so that they fix alternately the upper body (3) on the central gear teeth (22) of the opposing planar surfaces of the corresponding flexible attachment (2, 2').

Figure 11:
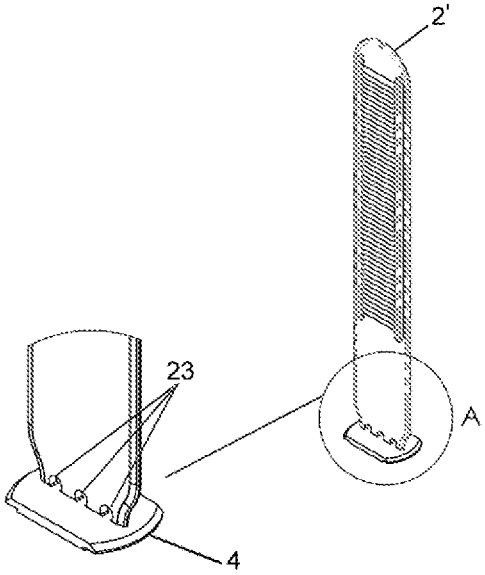
FIG. 11 shows a perspective view of the independent flexible attachment with an enlargement of the foot in the second embodiment.

As can be seen in the detail shown in FIGS. 1 and 11, the flexible attachments (2, 2') have at their lower end holes (23) which define a weakening area suitable for separating them from the base (1, 1', 1").

Figure 17:
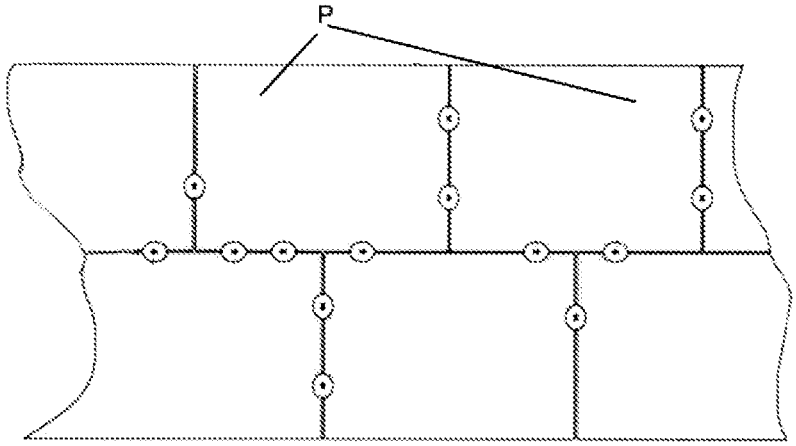
FIG. 17 shows a surface covered with tiles configured in staggered formation using the device in the invention.
Figure 18:
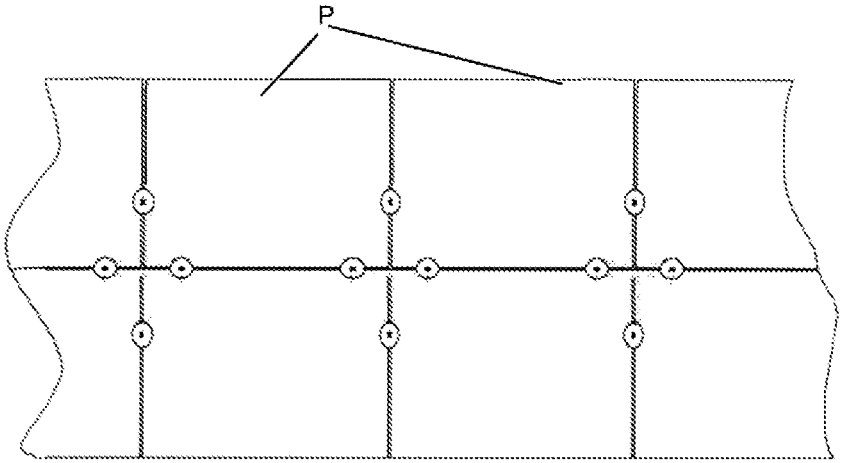
FIG. 18 shows a surface covered with tiles aligned using the device in the invention.

As can be seen in FIGS. 17 and 18, the incorporation in a same device of several flexible attachments (2, 2') allows the correct alignment of consecutive covering parts (P), supporting each of the upper bodies (3) on said consecutive parts (P), given that the flexible attachments (2, 2') of each device are already aligned longitudinally.

Once the covering parts (P) have been installed and the cement or fixing medium for the parts has set, the flexible attachments (2, 2') are stretched until they break at the point where they meet the base (1, 1', 1"), this base (1, 1', 1") thus conforming a residual component which remains embedded under the covering parts (P).

It should be noted that the improvement introduced by the second embodiment is substantial in terms of transport and manufacturing costs.

In terms of transport, because all the parts can be disassembled, they can be stacked to occupy a minimum amount of space.

In terms of manufacture, it should be noted not only that there is a radical reduction in manufacturing costs for the plastic parts, where the dimensions and complexity of an injection mould would considerably increase the cost of parts and the initial investment, but also in terms of the possibility of making the different components in different materials, selecting the most appropriate material for each requirement, with no need to use a single material for all the parts. This also means that the same component in the device can be made in different colours, to distinguish between them for any application, such as marking the first units used in an assembly.

Having described sufficiently the nature of the invention, and the examples of preferred embodiment, it can be stated for the relevant effects that the materials, shape, size and arrangement of the elements described may be modified, provided this does not mean an alteration in the essential characteristics of the invention for which the claims are set out below.

The invention claimed is:

1. A device for levelling and aligning surface covering parts in an installation of a surface of ceramic parts that are levelled and aligned using a securing product, said device comprising:

a base with an undulated surface, creating a series of alternating troughs and peaks along a length of the base, for a penetration of the securing product for the covering parts; and at least two flexible planar attachments, which protrude from a top of the base, and are arranged to coincide with a longitudinal middle plane on the base, and separated along the length of the base; each of the flexible attachments having, on the opposing planar surfaces: side ribs for guiding and sliding assembly of two upper tightening bodies on an upper surface of the covering parts, and central gear teeth for an action of complementary teeth on the respective upper bodies, wherein the base has an orthogonal cross-shaped structure formed of four arms.

2. The device, according to claim 1, wherein the base comprises a rectangular promontory located in a geometrical center and oriented along two of the arms of a cross-shaped base.

3. The device, according to claim 2, wherein one of the arms of the cross-shaped base comprises, at a non-free end, a crosswise weakening line which continues along the line of the adjacent arms for separating the arm from the rest of the base, which is left with a T-shaped structure.

4. The device, according to claim 3, wherein each of the arms of the base comprises a projection, with a rectangular drill-hole positioned to coincide with the base, which forms a hollow in the opposite side of the base which copies the structure of the projection to maintain the thickness of the base.

5. The device, according to claim 1, wherein each arm of the base comprises a projection, with a rectangular drill-hole positioned to coincide with the base, which forms a hollow in the opposite side of the base in order to maintain a thickness of the base.

6. The device, according to claim 5, wherein the projection has a rectangular structure with curved shorter sides and the longer sides parallel to the rectangular drill-hole.

7. The device, according to claim 5, wherein the independent flexible attachment comprises a support which fits into the hollow of the projection when inserted through the rectangular drill-hole in the projection.

8. The device, according to claim 7, wherein the base comprises lines of drill-holes located crosswise on each side of the rectangular drill-holes.

9. The device, according to claim 5, wherein the base comprises lines of drill-holes located crosswise on each side of the rectangular drill-holes.

10. The device, according to claim 1, wherein the non-free end of the flexible attachments has holes which define a weakening area for breaking.

* * * * *